US009742114B2

(12) United States Patent
Sasaki et al.

(10) Patent No.: US 9,742,114 B2
(45) Date of Patent: Aug. 22, 2017

(54) CONNECTOR WITH A CLAW OF LOCKING MEMBER

(71) Applicant: Yazaki Corporation, Tokyo (JP)

(72) Inventors: Yasuhiro Sasaki, Makinohara (JP); Takumi Nakagishi, Makinohara (JP); Akihiro Tsuruta, Fujieda (JP); Kiyotaka Mizuno, Fujieda (JP)

(73) Assignee: Yazaki Corporation, Tokyo (JP)

( * ) Notice: Subject to any disclaimer, the term of this patent is extended or adjusted under 35 U.S.C. 154(b) by 0 days.

(21) Appl. No.: 15/171,209

(22) Filed: Jun. 2, 2016

(65) Prior Publication Data

US 2016/0359271 A1 Dec. 8, 2016

(30) Foreign Application Priority Data

Jun. 2, 2015 (JP) ..... 2015-112137

(51) Int. Cl.
*H01R 13/627* (2006.01)
*H01R 13/639* (2006.01)

(52) U.S. Cl.
CPC ..... *H01R 13/639* (2013.01); *H01R 13/6272* (2013.01)

(58) Field of Classification Search
CPC ..... H01R 13/627
USPC ..... 439/353–358
See application file for complete search history.

(56) References Cited

U.S. PATENT DOCUMENTS 4,621,885 A * 11/1986 Szczesny ..... H01R 12/675 439/357
5,713,752 A * 2/1998 Leong ..... H01R 13/6275 439/358
5,788,527 A * 8/1998 Sanders ..... H01R 13/6272 439/352
6,296,508 B1 * 10/2001 Kuwahara ..... H01R 13/6273 439/353
7,175,465 B1 * 2/2007 Tsai ..... H01R 13/6275 439/352
7,455,545 B2 * 11/2008 Chawgo ..... H01R 13/6275 439/352
8,083,535 B2 * 12/2011 Chang ..... H01R 13/6272 439/357

(Continued)

FOREIGN PATENT DOCUMENTS

JP 2001110522 A 4/2001
JP 2012079596 A 4/2012
JP 2013-243008 A 12/2013

OTHER PUBLICATIONS

Office Action mailed on May 16, 2017 issued for corresponding Japanese Patent Application No. 2015-112137.

*Primary Examiner* — Neil Abrams
(74) *Attorney, Agent, or Firm* — Locke Lord LLP

(57) ABSTRACT

A connector is fitted into a mating connector including a receiving member, and includes a locking arm for locking the receiving member. The locking arm includes an arm member which extends in a fitting direction to the mating connector, and a locking member which is provided at a tip end of the arm member or in the neighborhood thereof so as to project in a direction intersecting the direction of fitting, and locks the receiving member. The locking member includes a claw which is formed at a tip end of the locking member so as to project in a direction opposite to the fitting direction to the mating connector and is caught by the receiving member.

2 Claims, 6 Drawing Sheets

(56) References Cited

U.S. PATENT DOCUMENTS

| | | | | |
|---|---|---|---|---|
| 8,287,299 | B2 * | 10/2012 | Ray | H01R 13/6273<br>439/353 |
| 2016/0359271 | A1 * | 12/2016 | Sasaki | H01R 13/6272 |

* cited by examiner

CONNECTOR WITH A CLAW OF LOCKING MEMBER

BACKGROUND

Technical Field

The present invention relates to a connector.

Related Art

FIG. 8 shows a conventional connector disclosed in JP 2013-243008 A, and is a sectional view showing fitting between a first housing and a second housing. As shown in FIG. 8, conventionally disclosed is a connector 100 which includes a first housing 101 and a second housing 102 and is configured in such a manner that the two housings 101 and 102 can be kept fitted into each other by a locking operation of a lock arm 110 provided in the first housing 101 and a locking projection 120 provided in the second housing 102 (for example, see Patent Literature 1).

The lock arm 110 includes an arm 111 which is formed so as to extend from an outer surface of the first housing 101 in approximately the same direction as a direction in which the first housing 101 is fitted into the second housing 102. The lock arm 110 further includes a locking projection 112 which is formed at a tip end of the arm 111 so as to project toward the locking projection 120 of the second housing 102 and is locked to the locking projection 120. The lock arm 110 is configured so as to be elastically displaceable in an unlocking direction in which the lock arm 110 separates from an outer surface of the first housing 101.

The locking projection 112 has a first locking surface 113 which is locked to the locking projection 120. The first locking surface 113 is set to be inclined in such a manner that a lower end (projection end) is located closer to a root side of the arm 111 than an upper end (a base end of the locking projection 112) in a natural state where the lock arm 110 is not elastically displaced. Also, the locking projection 120 has a second locking surface 121 which is approximately perpendicular to a fitting direction in which the two housings 101 and 102 are fitted into each other.

During processes in which the above-described two housings 101 and 102 are fitted into each other, the locking projection 112 gets over the locking projection 120 and the lock arm 110 elastically returns, so that the first locking surface 113 is locked to the second locking surface 121. In this state, the first housing 101 is restrained from moving in a direction in which the first housing 101 separates from the second housing 102, so that the two housings 101 and 102 are kept fitted into each other.

FIGS. 9A to 9C are views for explaining disadvantages in a conventional general connector. FIG. 9A is a view showing a state in which the lock arm 110 is locked to the second locking surface 121. FIG. 9B is a view showing a state in which one of the two housings 101 and 102 is pulled in a direction in which one of the two housings 101 and 102 separates from the other in the state shown in FIG. 9A. FIG. 9C is a view showing a state in which one of the two housings 101 and 102 is further pulled as compared to the state shown in FIG. 9B. More specifically, when one of the two housings 101 and 102 is pulled in a direction in which one of the two housings 101 and 102 separates from the other, the first locking surface 113 is displaced from a position where the first locking surface 113 is inclined in such a manner that a lower end thereof (projection end) is located closer to a root side of the arm 111 than an upper end thereof (base end of the locking projection 112) as shown in FIG. 9A, to a position where a lower end of the first locking surface 113 is located far from a root of the arm 111 as shown in FIG. 9B. Thus, the first locking surface 113 becomes approximately perpendicular to a fitting direction of the two housings 101 and 102. Then, the first locking surface 113 slides on the second locking surface 121, and the lock arm 110 comes out upwardly. Moreover, as one of the two housings 101 and 102 is further pulled to thereby further separate from the other, the first locking surface 113 is further displaced to a position where a lower end of the first locking surface 113 is located farther from a root of the arm 111 as shown in FIG. 9C. This may cause the first locking surface 113 being locked to the second locking surface 121 to be unlocked, resulting in release of fitting between two connectors.

Patent Literature 1: JP 2013-243008 A

SUMMARY

Thus, it is an object of the present invention to provide a connector, of which fitting into another connector is difficult to be released even though the connectors being fitted into each other are pulled in a direction in which the connectors separate from each other.

In order to solve the above issue, the present invention has configurations described below.

That is, the present invention according to a first aspect is a connector which is fitted into a mating connector including a receiving member, including a locking arm for locking the receiving member in order to keep the connector and the mating connector fitted into each other, wherein the locking arm includes an arm member which extends in a direction of fitting between the connector and the mating connector, and a locking member which is provided at a tip end of the arm member or in the neighborhood thereof so as to project in a direction intersecting the direction of fitting, and locks the receiving member, and the locking member includes a claw which is formed at a tip end of the locking member so as to project in a direction opposite to the direction of fitting between the connector and the mating connector and is caught by the receiving member.

The invention according to a second aspect is the present invention according to the first aspect, further including a pushing member for pushing the receiving member toward the arm member when the mating connector is fitted into the connector, the pushing member being provided so as to project toward the arm member.

The invention according to a third aspect is the present invention according to the second aspect, wherein during processes in which the connector is fitted into the mating connector, the pushing member is provided in a position where the pushing member comes into contact with the mating connector after the locking member comes into contact with the mating connector.

According to the invention according to the first aspect, the locking arm includes the claw which is formed at a tip end of the locking member so as to project in a direction opposite to the direction of fitting between the connector and the mating connector, and is caught by the receiving member. Even though one of the two connectors is pulled in a direction in which one of the two connectors separates from the other, it is difficult to move such a connector as recited in a direction in which the receiving member being locked to the locking arm is unlocked, because the claw is caught by the receiving member. Therefore, it is possible to provide a connector, of which fitting into another connector is difficult to be released even though two connectors being fitted into each other are pulled in a direction in which the two connectors separate from each other.

According to the invention according to the second aspect, the pushing member for giving an impetus to the mating connector in order to push the receiving member toward the arm member when the mating connector is fitted into the connector, is provided so as to project toward the arm member. As a result of this, when the two connectors are fitted into each other, the receiving member is pushed toward the arm member, so that the claw is certainly caught by the receiving member. Therefore, the locking arm can more reliably lock the receiving member, and it is possible to make it more difficult to unlock the receiving member being locked to the locking arm.

According to the invention according to the third aspect, during processes in which the connector is fitted into the mating connector, the pushing member is provided in a position where the pushing member comes into contact with the mating connector after the locking member comes into contact with the mating connector. That is, the pushing member comes into contact with the mating connector after the locking member comes into contact with the mating connector. Thus, it is possible to disperse a force required for the locking arm to lock the receiving member, as compared to a case where the locking member and the pushing member simultaneously come into contact with the mating connector.

DETAILED DESCRIPTION

A connector according to one embodiment of the present invention and a connector unit including the connector will be described with reference to FIGS. 1 to 6.

Figure 1:
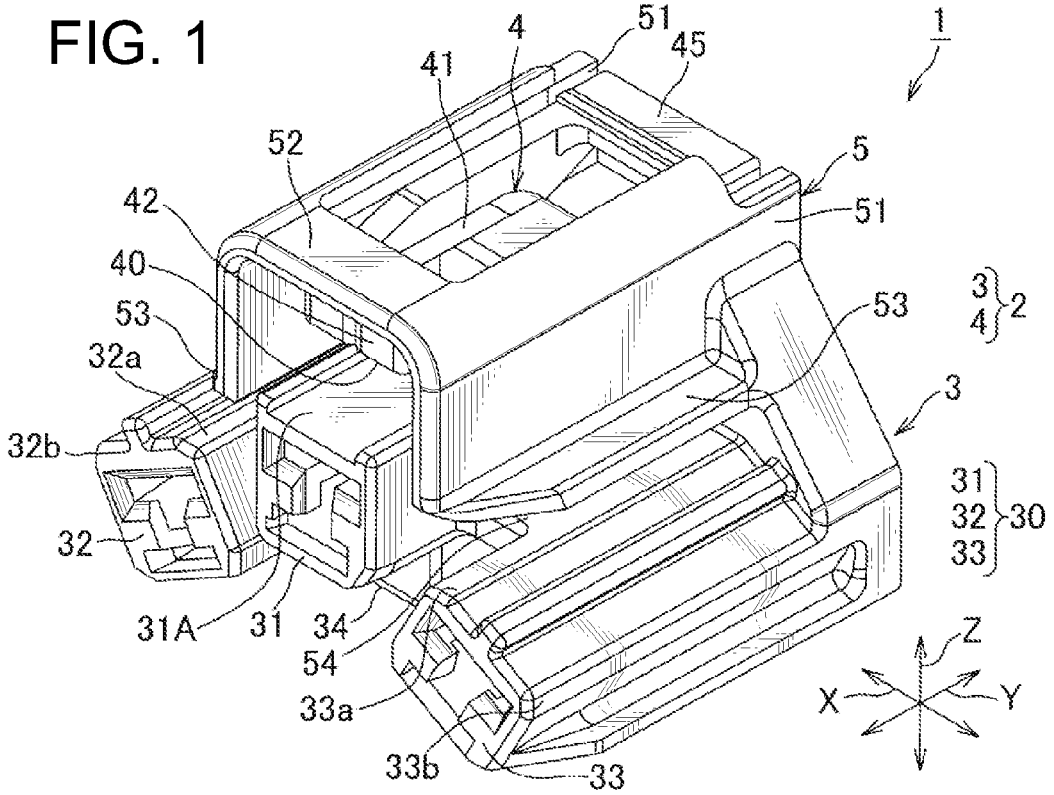
FIG. 1 is a perspective view showing a connector according to one embodiment of the present invention.
Figure 2:
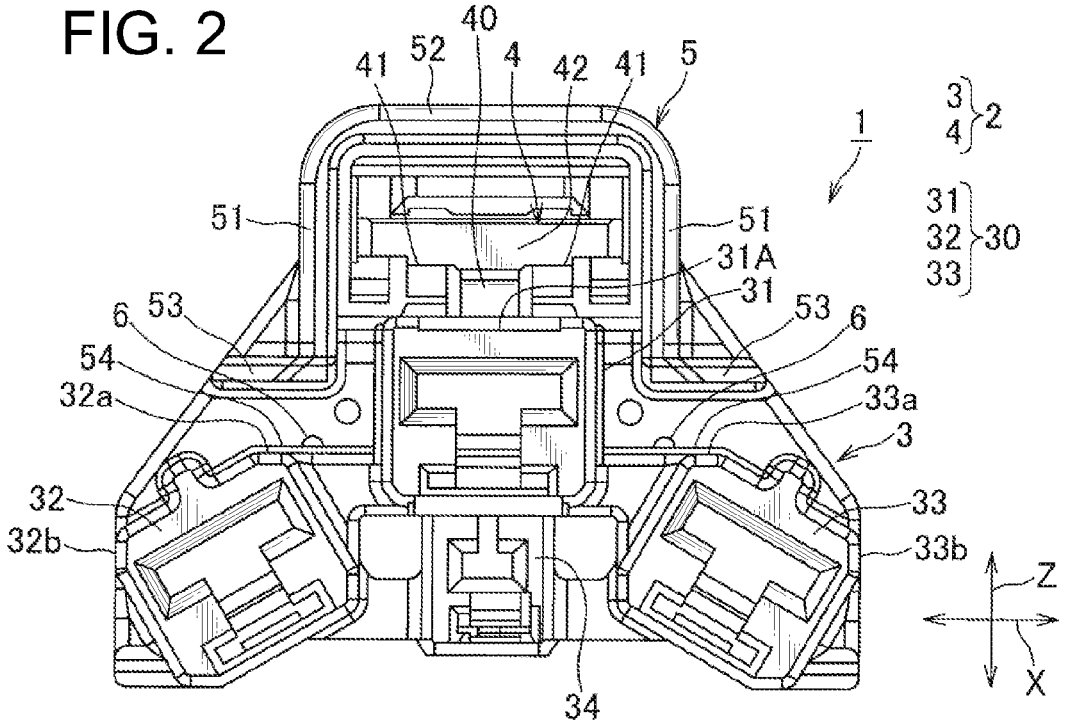
FIG. 2 is a front view showing the connector shown in FIG. 1.
Figure 3A:
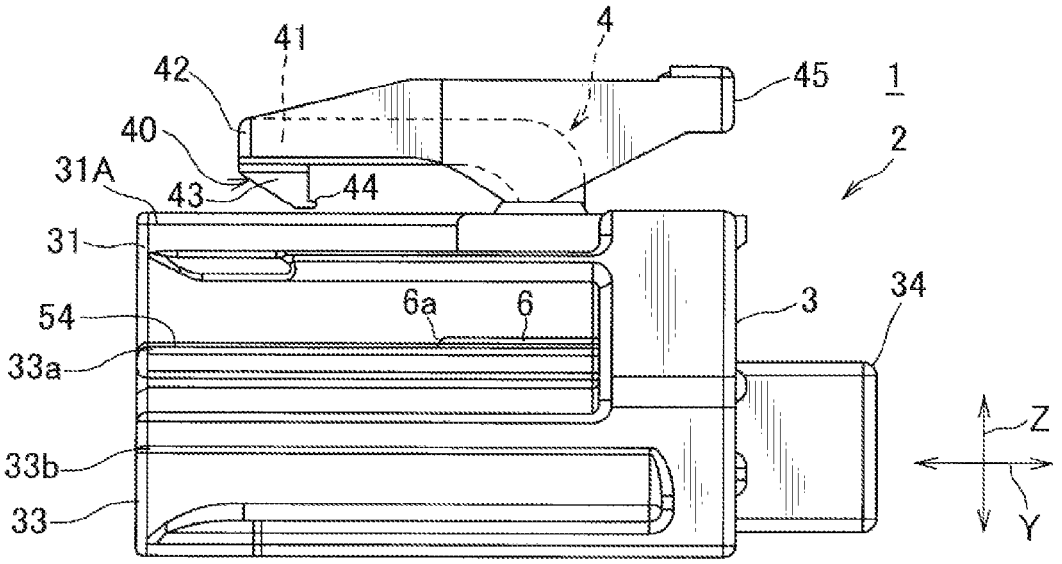
FIG. 3A is a side view of the connector shown in FIG. 1, in which a protection wall is omitted.
Figure 3B:
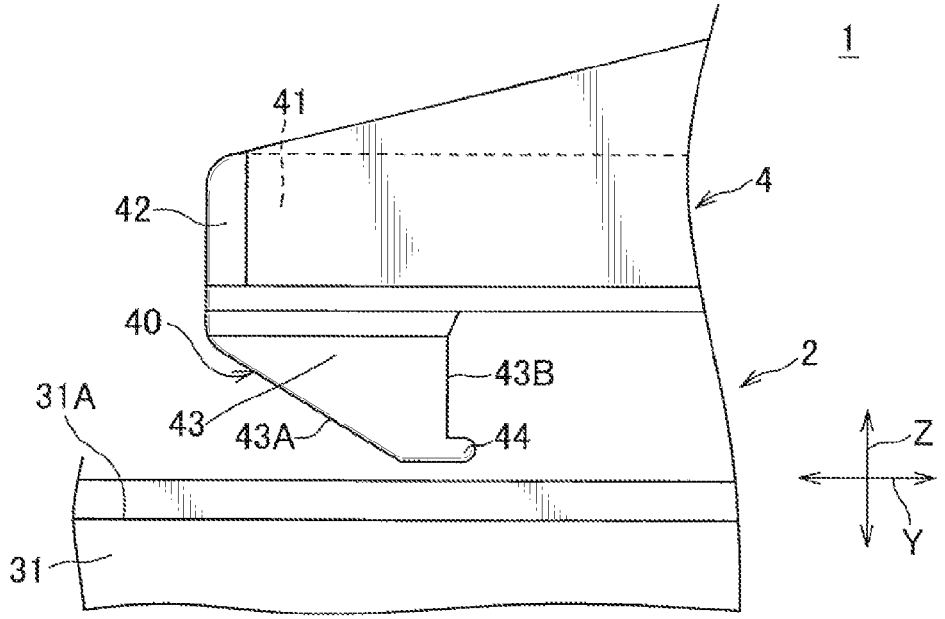
FIG. 3B is an enlarged view of principal parts of FIG. 3A.
Figure 4A:
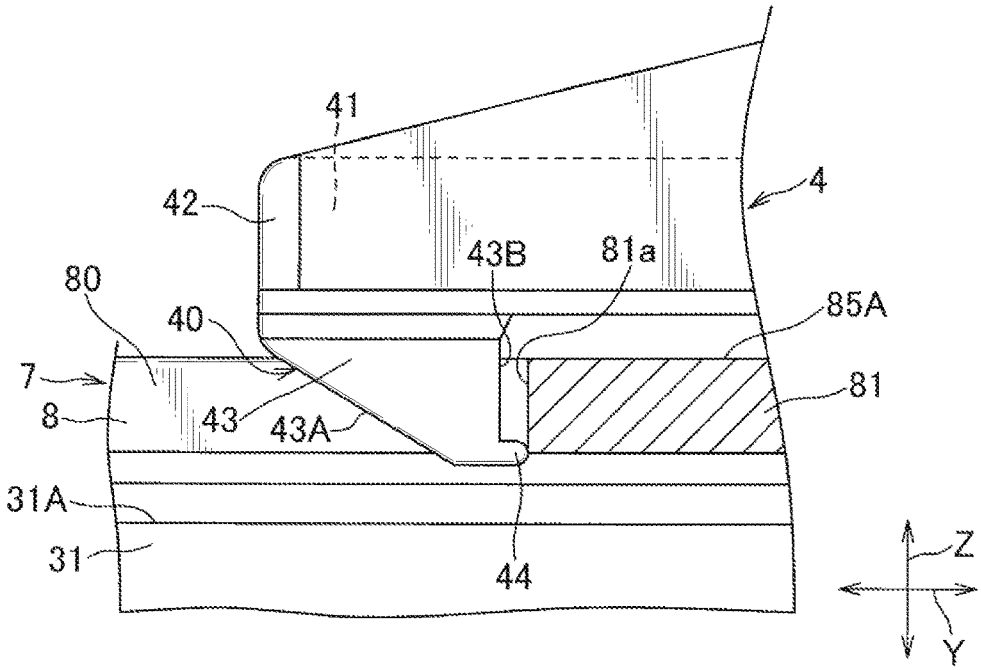
FIG. 4A is a view for explain actions of a pushing member formed in the connector shown in FIG. 1 and shows a case where the pushing member is not formed.
Figure 4B:
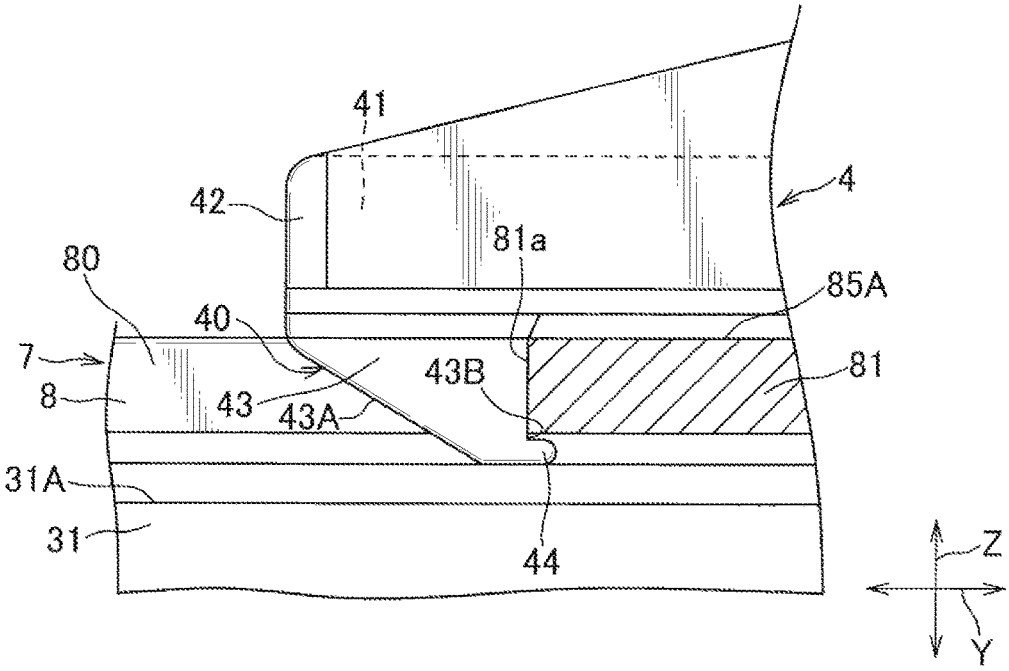
FIG. 4B is a view for explain actions of a pushing member formed in the connector shown in FIG. 1 and shows a state where a receiving member is pushed toward an arm member by the pushing member.
Figure 5:
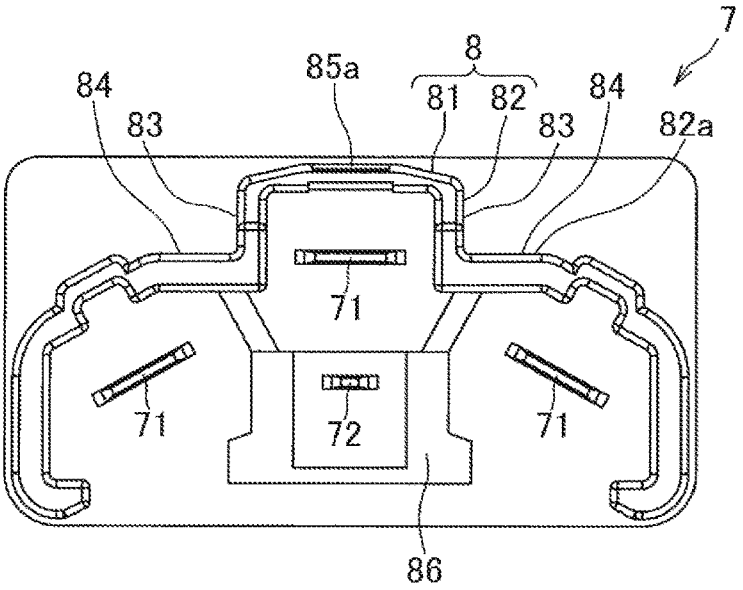
FIG. 5 is a front view of a mating connector which is fitted into the connector shown in FIG. 1.
Figure 6:
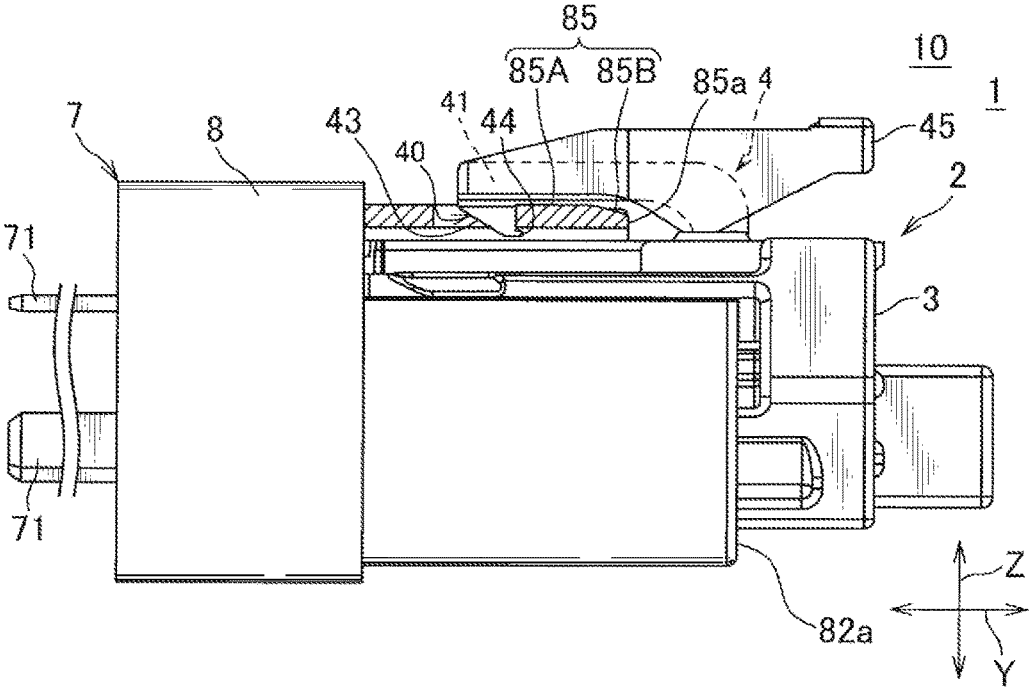
FIG. 6 is a view showing fitting between the connector shown in FIG. 3A and a mating connector, including a sectional view of a part thereof.

FIG. 1 is a perspective view of the connector according to one embodiment of the present invention. FIG. 2 is a front view of the connector shown in FIG. 1, when viewed from a fitting surface. FIG. 3A is a side view of the connector shown in FIG. 1, in which a protection wall 5 is omitted, and FIG. 3B is an enlarged view of principal parts of FIG. 3A. FIGS. 4A and 4B are views for explaining actions of a pushing member formed in the connector shown in FIG. 1. FIG. 4A is a view showing a case where the pushing member is not formed, and FIG. 4B is a view showing a state where a receiving member is pushed toward an arm member by the pushing member. FIG. 5 is a front view of a mating connector which is fitted into the connector shown in FIG. 1. FIG. 6 is a view showing fitting between the connector shown in FIG. 3A and a mating connector, including a sectional view of a part thereof.

As shown in FIGS. 1 to 6, a connector unit 10 includes a female connector 1 (connector) and a male connector 7 (mating connector) which is fitted into the female connector 1.

Here, arrows Y, X, and Z shown in FIG. 1 and the like indicate directions orthogonal to one another. In the following description, the arrow Y in FIG. 1 is a direction of fitting between the female connector 1 and the male connector 7. Also, a "fitting direction" in this description is a direction in which the female connector 1 and the male connector 7 get closer to each other. That is, a fitting direction of the female connector 1 (which will be sometimes referred to as "front" or the like) is a direction toward a front of the perpendicular to a paper sheet of FIG. 2. Also, an opposite fitting direction of the female connector (which will be sometimes referred to as "rear" or the like) is a direction toward a backside of the perpendicular to a paper sheet of FIG. 2. Similarly, regarding the male connector 7, a fitting direction thereof will be sometimes referred to as "front" or the like, and an opposite fitting direction thereof will be sometimes referred to as "rear" or the like. Further, the arrow X (which will be sometimes referred to as a "lateral direction") in FIGS. 1, 2, and the like is one direction orthogonal to the arrow Y. The arrow Z (which will be sometimes referred to as a "vertical direction") in FIGS. 1, 2, and the like is a direction orthogonal to both of the arrow Y and the arrow X, and indicates a direction in which the locking arm 4 elastically deforms.

First, a structure of the female connector 1 will be described with reference to FIGS. 1 to 3B. The female connector 1 includes a plurality of female terminals (not shown in the drawings) and a female-side housing 2 for housing the female terminals. The female terminals, which are formed of a conductive material, are known female terminals electrically connected to male terminals 70 of the male connector 7 which will be described later. The female terminals include three first female terminals connected to a power supply line, and one second female terminal connected to a signal line.

As shown in FIGS. 1 and 2, the female-side housing 2 is formed of a synthetic resin or the like, and includes a housing body 3 including a plurality of terminal housing members 30 in which the plurality of female terminals are respectively housed, a locking arm 4 which is provided integrally with the housing body 3 and serves to keep the female connector 1 and the male connector 7 fitted into each other, and a protection wall 5 for protecting the locking arm 4 over the locking arm 4. The housing body 3, the locking arm 4 and the protection wall 5 are provided integrally with one another.

Each of the plurality of terminal housing members 30 is perforated in a fitting direction (Y-arrow direction), and is formed into a shape of a rectangular tube so that each female terminal can be housed therein. Respective lower ends of the plurality of terminal housing members 30 are connected. The plurality of terminal housing members 30 include three first terminal housing members 31, 32, and 33 in which the first female terminals are respectively housed, and one second terminal housing member 34 in which the second female terminal is housed.

Among the three first terminal housing members 31, 32, and 33, as shown in FIG. 2, the first terminal housing member 31 is placed in a central area, and the other first terminal housing members 32 and 33 are placed on opposite sides of the first terminal housing member 31 placed in a central area in positions shifted downward with respect to the first terminal housing member 31. Also, the first terminal housing member 31 placed in a central area is set in such a manner that left and right edges of an upper surface thereof are at almost the same height. The first terminal housing member 32 on a left side is set to be inclined in such a manner that a left edge 32*b* of an upper surface thereof is located lower than a right edge 32*a*. The first terminal housing member 33 on a right side is set to be inclined in such a manner that a right edge 33*b* of an upper surface thereof is located lower than a left edge 33*a*.

The second terminal housing member 34 is provided adjacent to a space under the first terminal housing member 31 placed in a central area, and is located between the first terminal housing members 32 and 33, as shown in FIG. 2. The second terminal housing member 34 is set in such a manner that a front end thereof is located in a position shifted rearward with respect to front ends of the first terminal housing members 31, 32, and 33 and a rear end thereof projects rearward from rear ends of the first terminal housing members 31, 32, and 33, as shown in FIG. 3A.

As shown in FIGS. 2 and 3A, the locking arm 4 includes a pair of arm members 41, a connecting member 42 (shown in FIG. 2), a locking body 43, and a claw 44. The pair of arm members 41 are arranged in a lateral direction (X-arrow direction) with a space therebetween, long and extend in a fitting direction (Y-arrow direction). The connecting member 42 (shown in FIG. 2) connects respective free ends (tip ends) of the pair of arm members 41. The locking body 43 is formed so as to project downward from the connecting member 42. The claw 44 is formed so as to project rearward (in an opposite fitting direction) from a projecting-side end of the locking body 43. The locking body 43 and the claw 44 form a "locking member" (denoted by a reference symbol "40") in claims. In the above-described locking arm 4, the arm members 41 are provided so as to be elastically deformable in a vertical direction (Z-arrow direction), and elastic deformation of the arm members 41 causes the locking member 40 to be vertically displaced. It is noted that though the locking member 40 is provided at tip ends of the arm members 41 in this embodiment, the locking member can be provided in a position closer to base ends, away from tip ends of the arm members 41. In other words, the locking member can be provided in any position that can allow vertical displacement of the locking member in the arm members 41.

Also, the locking arm 4 is formed in such a manner that the arm members 41, the locking body 43, and the claw 44 take a shape of an almost U-shape, as shown in FIG. 3B. Further, the locking arm 4 is provided in such a manner that the respective arm members 41 and the claw 44 are vertically spaced from each other, so that a receiving member 81 (shown in FIG. 4) of the male connector 7 which is locked by the locking arm 4 can be housed between the arm members 41 and the claw 44.

The locking body 43 includes a taper 43A which allows the locking member 40 to easily get on the receiving member 81, and a locking surface 43B which faces an end surface 81*a* of the receiving member 81 while the locking member 40 is locking the receiving member 81, as shown in FIG. 3B. Also, the locking surface 43B is provided to be approximately perpendicular to a fitting direction (Y-arrow direction) in a natural state where the arm members 41 do not elastically deform.

The claw 44 is formed into a shape of an ellipse which includes a curved surface not having an angled area when viewed from a side, as shown in FIG. 3B. Provision of such the claw 44 facilitates housing of the receiving member 81 between the arm members 41 and the claw 44 when the locking arm 4 locks the receiving member 81. Though the claw 44 is formed into a shape of an ellipse which includes a curved surface not having an angled area when viewed from a side in this embodiment, the present invention is not limited to that. The claw 44 may be formed into a rectangular shape which has upper and lower angled areas when viewed from a side. Alternatively, the claw 44 may be formed into a shape in which only a lower area is angled and an upper area corresponding to an angled area includes a curved surface not having an angled area when viewed from a side.

Further, as shown in FIG. 3A, the locking arm 4 includes an operating member 45 for unlocking the receiving member 81 being locked to the locking arm 4. By pressing the operating member 45, the receiving member 81 being locked to the locking arm 4 can be unlocked.

As shown in FIGS. 1 and 2, the protection wall 5 is provided on opposite sides of the locking arm 4. The protection wall 5 includes a pair of side walls 51 which laterally face each other, a top wall 52 which connects respective upper ends of the pair of side walls 51, and a pair of extension walls 53 which are formed of parts extending leftward and rightward from respective lower ends of the pair of side walls 51. The top wall 52 is locally cut out in a rectangular shape. As a result of this, a locking condition of the locking arm 4 can be visually recognized.

The above-described protection wall 5 is configured so as to not only protect the locking arm 4, but also guide the locking arm 4 toward the receiving member 81 for locking. More specifically, side plates 83 which are provided in the male connector 7 and respectively face the pair of side walls 51 slide along the pair of side walls 51 in the protection wall 5, to be guided rearward.

Moreover, the female-side housing 2 includes a rib 6 (pushing member) for pushing the receiving member 81 upward, as shown in FIGS. 2 and 3A. The rib 6 is provided in each of facing walls 54 which face the pair of the extension walls 53 on lower sides of the pair of extension walls 53, and the rib 6 is formed so as to project upward with respect to the facing wall 54 and extend in a fitting direction (Y-arrow direction).

Regarding the above-described rib 6, when a part of a peripheral wall of a hood member 82 (shown in FIG. 5) of the male connector 7 (which part will be hereinafter referred to as a "pushed member 84") enters between the rib 6 and each of the extension walls 53, a state shown in FIG. 4A is changed to a state shown in FIG. 4B, that is, the pushed member 84 is pushed upward, so that the receiving member 81 which is continuous with the pushed member 84 is pushed up. As a result of this, the receiving member 81 is housed between the arm members 41 and the claw 44 when the two connectors 1 and 7 are fitted into each other. In such a state, even if one of the two connectors 1 and 7 is pulled in a direction in which one of the two connectors 1 and 7 separates from the other, the claw 44 is caught by the receiving member 81, to cause difficulties in movement in a direction in which the receiving member 81 being locked to the locking arm 4 is unlocked. Thus, the claw 44 is configured in such a manner that the claw 44 can be caught by the receiving member 81 when one of the two connectors 1 and 7 is pulled in a direction in which one of the two connectors land 7 separates from the other.

Also, the rib 6 is not in contact with the male connector 7 when the locking member 40 comes into contact with the male connector 7. More specifically, the rib 6 is configured in such a manner that a front end 6*a* of the rib 6 comes into contact with the male connector 7 when the locking member 40 gets on a getting-on stage 85 and is located on a flat surface 85A. Alternatively, the rib 6 may be configured in such a manner that the front end 6*a* of the rib 6 comes into contact with the male connector 7 while the locking member 40 is sliding from a front end to a rear end of the flat surface 85A. As a result of this, a force with which the locking member 40 gets on the getting-on stage 85 and a force with which the locking member 40 gets on the rib 6 are not simultaneously applied to an operator. Accordingly, it is possible to disperse a force required for the locking arm 4 to lock the receiving member 81, as compared to a case where the locking member 40 and the rib 6 simultaneously come into contact with the male connector 7.

Next, a structure of the male connector 7 will be described with reference to FIGS. 4, 5, and 6. The male connector 7 includes the male terminals 70 and a male-side housing 8 as shown in FIG. 5. The male terminals 70, which are formed of a conductive material, are known male terminals electrically connected to female terminals. The male terminals 70 include three first male terminals 71 which are respectively connected to the first female terminals, and one second male terminal 72 connected to the second female terminal.

The male-side housing 8 is formed in a tubular shape, and includes the receiving member 81 and the hood member 82 which surrounds the male terminals around an axis extending in a fitting direction (Y-arrow direction), as shown in FIG. 5. The receiving member 81 is formed into a shape of a rectangular plate and set in such a manner that a thickness direction thereof agrees with a vertical direction (Z-arrow direction). An interior of the hood member 82 is partitioned by a partitioning wall 86 so that each of the terminal housing members 30 of the female-side housing 2 can enter thereinto. The hood member 82 includes a pair of side plates 83 which stand downward from left and right edges of the receiving member 81 and the pushed member 84 which extends in a lateral direction (X-arrow direction) from a lower end of each of the pair of side plates 83 and is pushed up by the rib 6.

The receiving member 81, as shown in FIG. 4, includes a through hole 80 which is formed in a central area of the receiving member 81 and has an end surface 81*a* locked by the locking arm 4 in a frontward area, and the getting-on stage 85 provided in front of the through hole 80. The end surface 81*a* of the through hole 80 is provided to be approximately perpendicular to a fitting direction (Y-arrow direction).

The getting-on stage 85 is set in such a manner that the front end 85*a* thereof (in the same position as the front end 85*a* of the receiving member 81) is located in the rear of a front end 82*a* of the hood member 82, as shown in FIGS. 5 and 6. Also, an upper surface of the getting-on stage 85 includes the flat surface 85A located in front of the end surface 81*a* and an inclined surface 85B located in front of the flat surface 85A.

Next, operations carried out when the above-described locking arm 4 locks the receiving member 81 will be described.

The female-side housing 2 is caused to enter into the hood member 82 of the male connector 7. The locking arm 4 comes into contact with the front end 85*a* of the getting-on stage 85. The female-side housing 2 is caused to enter further into the hood member 82, and then the arm members 41 elastically deform, so that the locking member 40 is displaced upward, to get on the inclined surface 85B. The female-side housing 2 is caused to enter still further into the hood member 82, and then the locking member 40 slides on the flat surface 85A. Thereafter, the front end 6*a* of the rib 6 comes into contact with the pushed member 84. As the female-side housing 2 is caused to enter even still further into the hood member 82, the pushed member 84 gets on the rib 6, to push up the receiving member 81. Thereafter, the locking member 40 drops into the through hole 80, so that the arm members 41 are put in a natural state. Thus, the locking surface 43B of the locking member 40 is locked to the end surface 81*a*. The receiving member 81 is housed between the arm members 41 and the claw 44. At that time, the claw 44 is provided in such a manner that the claw 44 can be caught by a lower end of the end surface 81*a* when one of the two connectors 1 and 7 is pulled in a direction in which one of the two connectors 1 and 7 separates from the other. As a result of this, the locking arm 4 locks the receiving member 81, so that the female connector 1 and the male connector 7 are fitted into each other.

In the above-described connector unit 10, even if one of the two connectors 1 and 7 is pulled in a direction in which one of the two connectors 1 and 7 separates from the other, it is difficult to make movement in a direction in which the receiving member 81 being locked to the locking arm 4 is unlocked, because the claw 44 is caught by a lower end of the end surface 81*a*. Therefore, it is possible to make it difficult to release fitting between the two connectors 1 and 7 even if the two connectors 1 and 7 being fitted into each other are pulled in a direction in which the two connectors 1 and 7 separate from each other.

It is noted that the present invention is not limited to the above-described embodiment and includes any other structures and the like that can attain the object of the present invention, and the following modifications and the like are included in the present invention. For example, in the female-side housing 2, though the housing body 3 and the locking arm 4 are provided integrally with each other, the present invention is not limited to such a structure. The locking arm 4 may be provided distinctly from the housing body 3. Also, though the locking arm 4 includes the pair of arm members 41, the locking arm 4 does not necessarily have a pair of arm members. The locking arm 4 can be implemented with one arm member or more.

Figure 7:
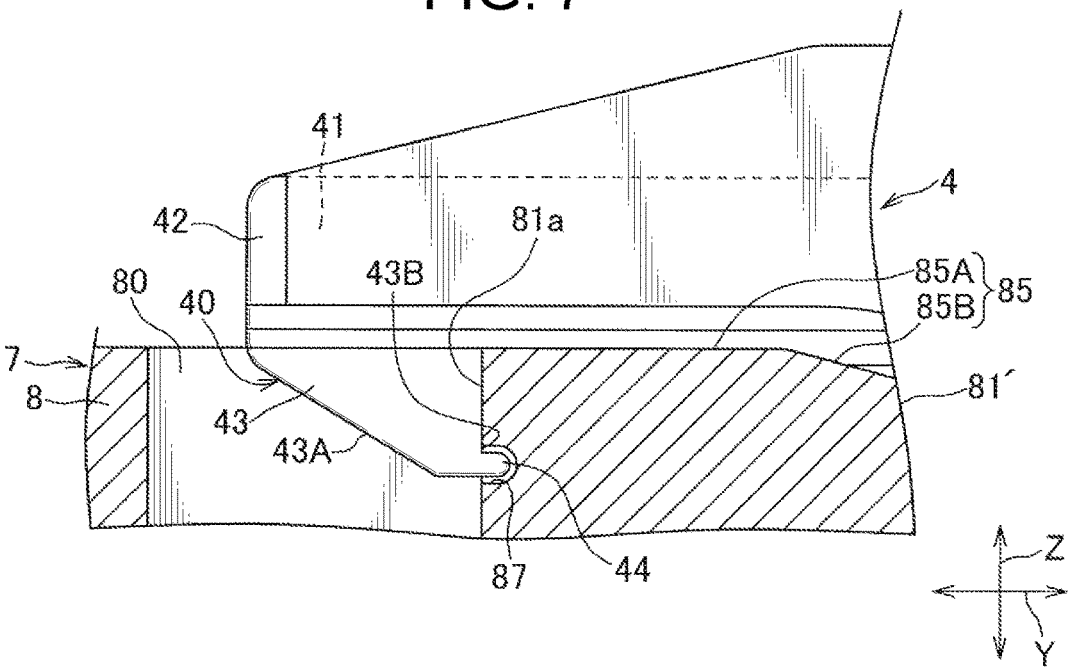
FIG. 7 is a sectional view showing a modification of the mating connector shown in FIG. 6.
Figure 8:
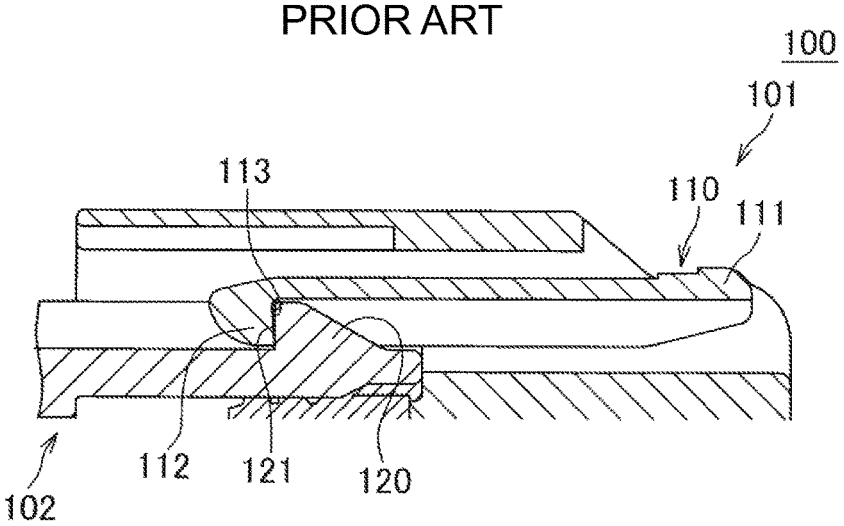
FIG. 8 PRIOR ART
FIG. 8 shows a conventional connector disclosed in JP 2013-243008 A, and is a sectional view of fitting between a first housing and a second housing.
Figure 9A:
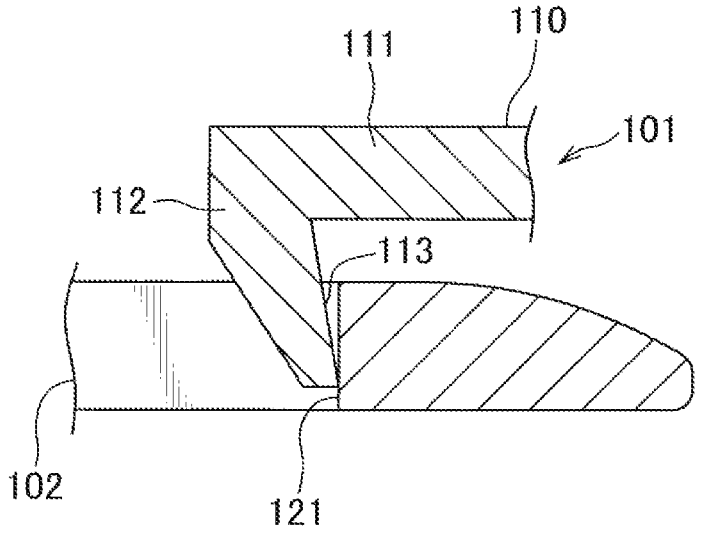
PRIOR ART FIG. 9A
FIG. 9A is a view for explaining disadvantages in the conventional connector, and shows a state where a lock arm is locked to a locking projection.
Figure 9B:
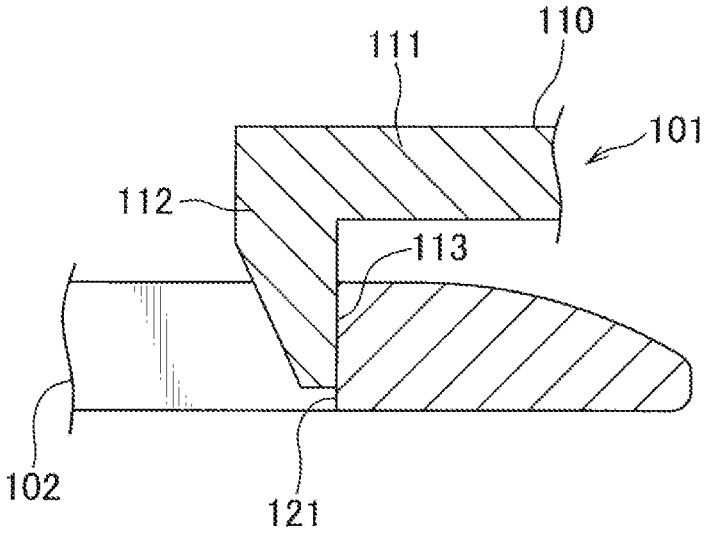
FIG. 9B is a view for explaining disadvantages in the conventional connector, and shows a state where one of two housings is pulled in a direction in which one of the two housings separates from the other in the state shown in FIG. 9A.
Figure 9C:
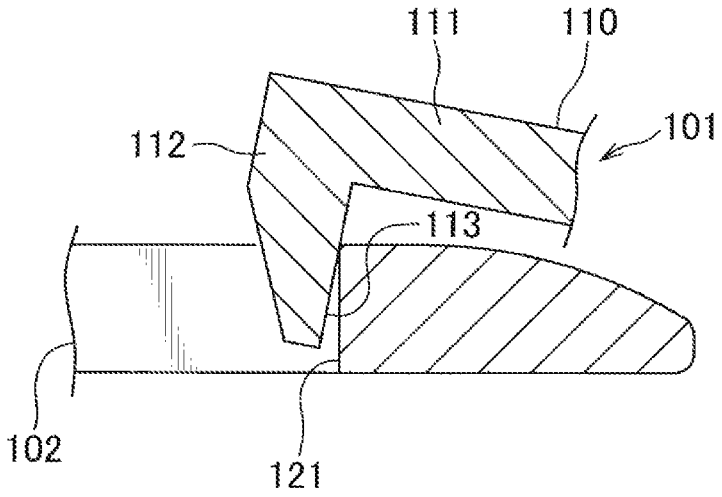
FIG. 9C is a view for explaining disadvantages in the conventional connector, and shows a state where one of the two housings is further pulled as compared to the state shown in FIG. 9B.

Also, in the male-side housing 8, though the receiving member 81 is configured in such a manner that a thickness thereof is smaller than a dimension of space between the arm members 41 and the claw 44 in order for the receiving member 81 to be housed between the arm members 41 and the claw 44, the present invention is not limited to such a structure. As shown in FIG. 7, in a case where it is desirable to increase a thickness of a receiving member 81', a recess 87 at which the claw 44 is caught may be formed in the end surface 81*a*.

Further, though the connectors 1 and 7 include four pairs of terminals which are electrically connected, the present invention is not limited to such a structure. The connectors 1 and 7 can be implemented by including one pair of terminals which are electrically connected, or more. Moreover, though a connector unit of a type in which the female connector 1 and the male connector 7 are electrically connected to each other has been described as one example of a connector unit, the present invention can be applied to not only a connector unit of the above-described type, but also a connector unit in which connectors are optically connected to each other.

The above-described embodiment is merely a representative embodiment of the present invention, and the present invention should not be limited to the embodiment. That is, the skilled person can carry out the present invention by making various modifications in accordance with conventionally-known knowledge without departing from an essence of the present invention. So long as the structure of the connector according to the present invention is still provided even if such modifications are made, the modifications are included within the scope of the present invention, as a matter of course.

REFERENCE SIGNS LIST

1 Female connector (connector)
4 Locking arm
6 Rib (pushing member)
7 Male connector (mating connector)
40 Locking member
41 Arm member
44 Claw
81 Receiving member

What is claimed is:

1. A connector which is fitted into a mating connector including a receiving member, the connector comprising:

a locking arm for locking the receiving member in order to keep the connector and the mating connector fitted into each other, wherein the locking arm includes an arm member extending in a fitting direction to the mating connector, and a locking member provided at a tip end of the arm member or in the neighborhood thereof so as to project in a direction crossing the fitting direction and to lock the receiving member of the mating connector, and the locking member includes a claw which is formed at a tip end of the locking member so as to project in a direction opposite to the fitting direction and by which the receiving member of the mating connector is caught, and further comprising a pushing member for pushing the receiving member of the mating connector toward the arm member when the mating connector is fitted into the connector, the pushing member being provided so as to project toward the arm member from a facing wall of the connector.

2. The connector according to claim 1, wherein when the connector is fitted into the mating connector, the pushing member is provided in a position where the pushing member comes into contact with the mating connector after the locking member comes into contact with the mating connector.

* * * * *